US010407822B2

(12) United States Patent
McCabe

(10) Patent No.: US 10,407,822 B2
(45) Date of Patent: Sep. 10, 2019

(54) SEPARATOR AND STACKER FOR TEXTILE ARTICLES

(71) Applicant: Stanley G. McCabe, Lubbock, TX (US)

(72) Inventor: Stanley G. McCabe, Lubbock, TX (US)

( * ) Notice: Subject to any disclaimer, the term of this patent is extended or adjusted under 35 U.S.C. 154(b) by 0 days.

(21) Appl. No.: 15/612,016

(22) Filed: Jun. 2, 2017

(65) Prior Publication Data

US 2018/0347104 A1 Dec. 6, 2018

(51) Int. Cl.

| | |
|---|---|
| ***D06F 67/04*** | (2006.01) |
| ***D06F 95/00*** | (2006.01) |
| ***B65H 3/26*** | (2006.01) |
| ***B65H 29/10*** | (2006.01) |
| ***B65H 31/02*** | (2006.01) |
| ***B65H 5/08*** | (2006.01) |

(52) U.S. Cl.

CPC ..... *D06F 95/00* (2013.01); *B65H 3/26* (2013.01); *B65H 5/08* (2013.01); *B65H 29/10* (2013.01); *B65H 31/02* (2013.01); *B65H 2301/4212* (2013.01); *B65H 2405/11152* (2013.01); *B65H 2701/174* (2013.01); *D06F 67/04* (2013.01)

(58) Field of Classification Search

CPC ..... D06F 67/04; D06F 95/00; D06C 3/00; B65H 2301/4212; Y10S 26/01

USPC ..... 26/87, 88, 89, 98; 38/102.7, 143; 414/13

See application file for complete search history.

(56) References Cited

U.S. PATENT DOCUMENTS

| | | | | | |
|---|---|---|---|---|---|
| 1,912,724 | A * | 6/1933 | Remington | D06F 67/04 | 26/87 |
| 2,262,236 | A * | 11/1941 | Huck | B65H 1/18 | 271/215 |
| 3,204,353 | A * | 9/1965 | Hajos | B65H 45/101 | 198/607 |
| 3,412,875 | A * | 11/1968 | Weir | D06F 89/00 | 414/13 |
| 3,431,665 | A * | 3/1969 | Weir | D06C 3/00 | 26/87 |
| 3,951,400 | A * | 4/1976 | Blessing | B65H 29/10 | 271/85 |

(Continued)

FOREIGN PATENT DOCUMENTS

| | | | | |
|---|---|---|---|---|
| GB | 1505855 | A * | 3/1978 | B65H 23/24 |
| WO | 2017060226 | | 4/2017 | |

*Primary Examiner* — Gregory W Adams

(74) *Attorney, Agent, or Firm* — Lempia Summerfield Katz LLC

(57) ABSTRACT

In laundry processing, a conveyor rotates a textile article in a first stage. The article is held while part of the article rests on the conveyor. By conveying while held, the textile article rotates, positioning an edge of the article. In a second stage, the conveyor conveys the article to a clamp. This clamp holds the article while the conveyor reverses direction and a blower attempts to flatten the article if folded. The textile article rotates, positioning the edge of the article to be more parallel with the direction of conveyance. In a third stage, the article is dragged by the edge over a gap where gravity and blowing attempt to flatten the article. In a fourth stage, the flattened article is positioned over a stack. A blower directs air at a center of the article to blow out the corners and assist in maintaining position.

25 Claims, 3 Drawing Sheets

(56) References Cited

U.S. PATENT DOCUMENTS 3,977,538 A * 8/1976 Crawford ..... B65H 29/46 414/788.3
3,989,239 A * 11/1976 Scriven, Jr. ..... B65H 29/041 271/204
4,299,521 A * 11/1981 Jensen ..... D06F 67/04 38/108
4,372,550 A * 2/1983 Woods ..... B65H 29/247 271/195
4,447,972 A 5/1984 McCabe
4,664,577 A * 5/1987 Bonali ..... B65H 29/04 271/186
4,702,468 A * 10/1987 Pollich ..... B65H 29/247 271/195
4,885,853 A 12/1989 McCabe
4,943,198 A 7/1990 McCabe
4,979,868 A * 12/1990 Ueda ..... B61B 10/025 38/12
5,018,463 A * 5/1991 Nakajima ..... B65H 29/041 112/303
5,040,778 A * 8/1991 Cole, Jr. ..... B65H 15/00 198/380
5,416,992 A * 5/1995 Ueda ..... D06F 67/04 198/689.1
5,515,627 A 5/1996 McCabe
5,518,103 A * 5/1996 Achelpohl ..... B65G 47/2445 198/415
5,988,510 A 11/1999 Tuttle et al.
6,068,192 A 5/2000 McCabe et al.
6,141,893 A 11/2000 McCabe
6,273,339 B1 8/2001 Tuttle et al.
6,439,370 B1 * 8/2002 Hoffman, Jr. ..... A41H 43/0235 198/468.2
6,477,797 B1 * 11/2002 Takahashi ..... D06F 67/04 38/143
6,533,267 B1 * 3/2003 Muessig ..... A41H 43/0264 112/306
6,826,856 B1 12/2004 McCabe
6,883,258 B2 4/2005 McCabe
7,127,840 B2 10/2006 McCabe
7,555,857 B2 7/2009 McCabe
7,827,709 B2 11/2010 McCabe
7,836,617 B2 11/2010 McCabe
8,424,875 B2 * 4/2013 Heise ..... B65H 15/00 271/176
8,584,832 B2 * 11/2013 Depoi ..... B65H 5/062 198/379
8,764,367 B2 7/2014 McCabe
9,222,213 B2 * 12/2015 Garrone ..... D06F 67/04

* cited by examiner

SEPARATOR AND STACKER FOR TEXTILE ARTICLES

BACKGROUND

The present embodiments relate to an automated laundry separator and stacker of textile articles.

A laundry separator receives a jumble or pile of articles, such as a cart (e.g., truck) or bag of towels from a washer or dryer. The separator separates individual articles from the pile and outputs individual pieces or a few pieces together for easier feeding into the next stage of automated processing. The separated articles may also be stacked. Where possible, automated processes may save money over time. Machines for automatically picking towels from a load of articles often operate too slowly, are too large, or have maintenance problems. Manual separation and stacking may be expensive.

SUMMARY

By way of introduction, the preferred embodiments described below include apparatuses and methods for processing textile articles from a bundle or pile of articles. The articles are processed as part of separating from the pile and/or stacking onto a stack. One embodiment includes a plurality of stages and features in the process from separating to stacking. Each of the individual stages may be used in different apparatuses. Each individual stage may be used with or without other stages. Any of the overall structure, individual stages, combinations of individual stages, and associated methods of the embodiments discussed below may be used independently or together in any laundry processing.

In a first stage, a conveyor rotates the textile article. The article is held while part of the article rests on the conveyor. By conveying while held, the textile article rotates, positioning an edge of the article more parallel with a direction of conveyance. In a second stage, the conveyor conveys the article to a clamp. This clamp holds the article while the conveyor reverses direction and a blower attempts to flatten the article if folded over (not flat). By conveying while held, the textile article rotates, positioning the edge of the article to be more parallel with the direction of conveyance. In a third stage, the article is dragged from the conveyor by the edge. The article is dragged over a gap where gravity and blowing attempt to flatten the article if still folded. The article is then dragged over a sensor platform to detect whether the article was flattened. In a fourth stage, the flattened article is positioned over a stack. An air nozzle or blower directs air at a center of the article to flatten out the corners and assist in maintaining position on the stack during release of the edge.

In a first aspect, an apparatus is provided for processing textile articles. A first conveyor has first and second ends connected by first and second sides. The conveyor is configured to convey from the first end to the second end. A first clamp is positioned to clamp at least a first one of the textile articles while the textile article extends between the first and second sides. The first conveyor is configured to convey the first textile article towards the second end while the first clamp clamps the first textile article. The first textile article rotates on the conveyor from the conveyance while the first article is clamped, and the first clamp is configured to release the first textile article when the rotation places an edge of the first textile article substantially parallel with the first side.

In a second aspect, a method is provided for processing textile articles. A first textile article is positioned over a conveyor perpendicular to a direction of conveyance of the conveyor. A portion of the first textile article is held while the conveyor conveys the first textile article. The first textile article rotates on the conveyor due to being held while the conveyor conveys. The first textile article is released from the holding after the rotating while the conveyor conveys.

In a third aspect, an apparatus is provided for processing textile articles. A clamp is positioned to clamp the first textile article. A conveyor is configured to convey a first textile article in a first direction to the clamp. The conveyor is configured to reverse direction from a first direction to a second direction while the clamp clamps the first textile article. The conveyance in the second direction while the clamp clamps rotates an edge of the first article to be more parallel with the first and second directions.

In a fourth aspect, an apparatus is provided for processing textile articles. A first platform is operable to support an edge of a textile article. A movable clamp is operable to clamp the edge and drag the textile article off the platform and over a gap. An air nozzle is configured to blow air onto the textile article when over the gap. A second platform has sensors. The moveable clamp is operable to drag the textile article over the second platform. The gap is between the first and second platforms.

In a fifth aspect, a method is provided for stacking a textile article. The textile article is held over a stack. Blowing is directed downward towards a center of the textile article while the textile article is positioned over the stack. The textile article is released, and the release is timed with the blowing.

The present invention is defined by the following claims, and nothing in this section should be taken as a limitation on those claims. Further aspects and advantages of the invention are discussed below in conjunction with the preferred embodiments.

BRIEF DESCRIPTION OF SEVERAL VIEWS OF THE DRAWINGS

The components of the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
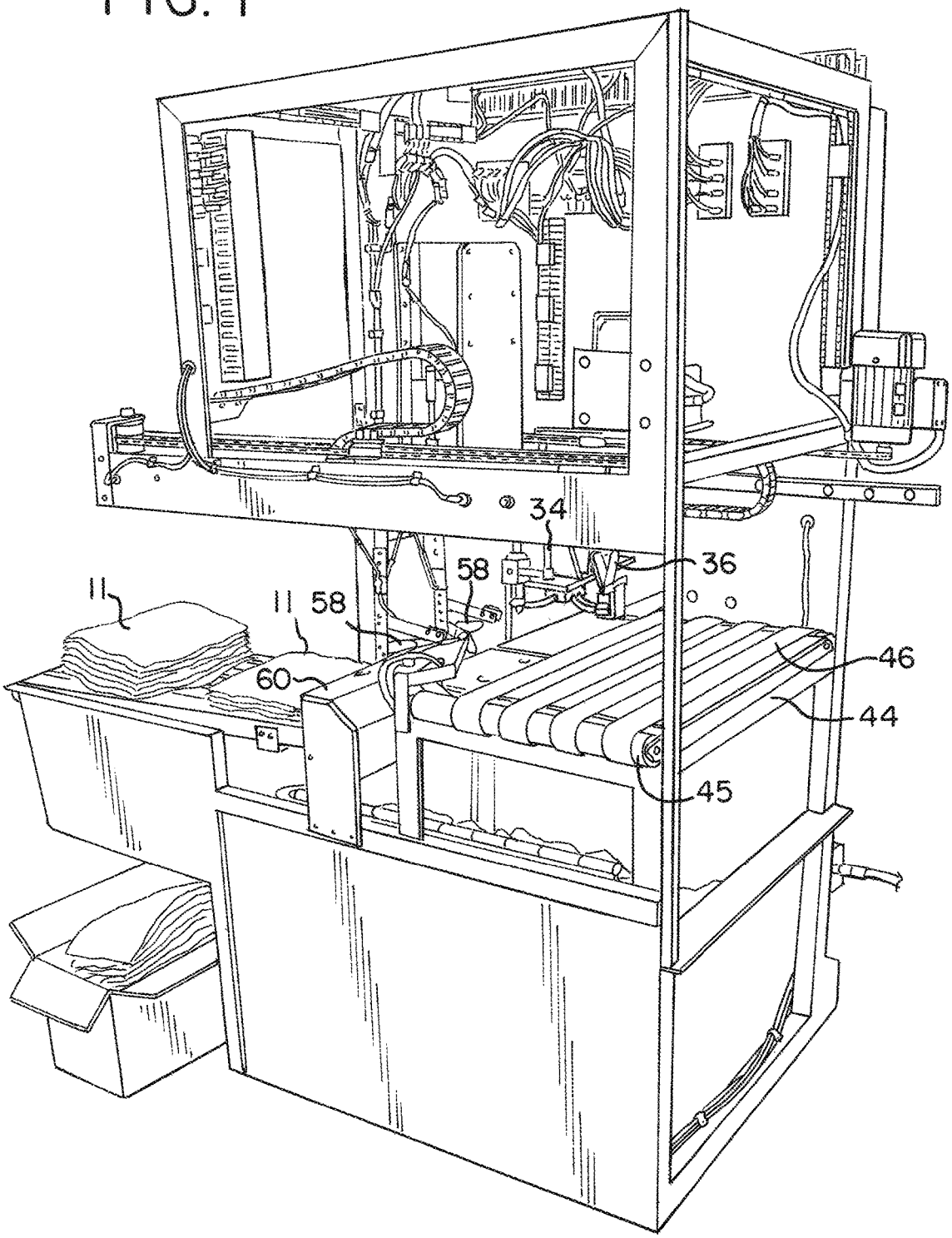
FIG. 1 is a side view of a laundry separator and stacker according to one embodiment.
Figure 2:
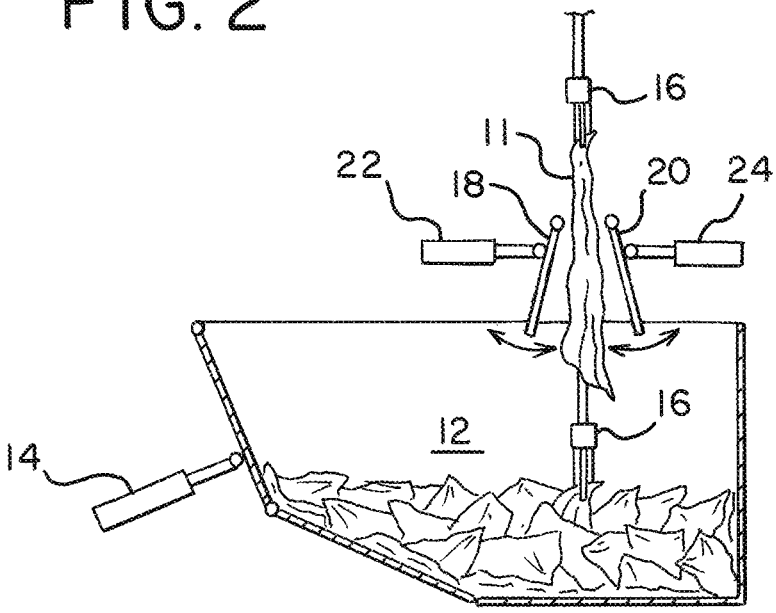
FIG. 2 is a side view of one embodiment for grabbing an article from a pile for processing.

FIGS. 1-5 show various aspects of one embodiment of a separator and/or stacker. Various stages and aspects of the embodiment may be altered or changed based on now known or later developed devices or methods. Various stages or aspects may be used in other types of devices, such as spreaders, feeders, stackers, ironers, or folders. For example, the use of the conveyor to rotate an edge may be used in an ironer, feeder, or folder.

The separator and/or stacker described herein is adapted for separating square or rectangular textile articles. Example textile articles include wash cloths, napkins, shop towels, table linen, other towels, or hand towels. The articles are flat and flexible. The articles may be square, but may be rectangular or have other shapes. A given pile may include only articles of the same type and size, but may include a mix of types, shapes, and/or sizes. Larger or smaller textile articles may also be processed, such as towels, pillow cases, pillow shams, sheets, or other laundry articles. The articles are wet, damp, or dry. For example, the articles are a pile of dried wash cloths in a truck or cart after removal from a drying machine. In other embodiments, the articles are wet, such as being from a washing machine.

FIGS. 1-5 show one apparatus positioned within a single frame structure. Different portions of the apparatus are shown in different views to illustrate the components in operation of various stages for separating and stacking a towel. In one embodiment, the stages are built together within the frame in as small a space as possible while providing sufficient volume for separating and stacking the towels. Due to the use of the conveyor for rotation, the lateral size of the apparatus for separating and stacking may be smaller or larger, such as less than 4-6 feet per side for processing 8-12 inch square articles. Other sizes may be used.

Various parts are provided, but not shown for clarity. Plates for safety and preventing operators from entanglement within the separator are included. Electrical, hydraulic, and/or air pressure cables and hoses interconnect various components for controlling and operating separating and stacking of the towels. These cables and hoses are configured and routed as is known in the art or later developed. One or more controllers also control the actions of various components as is known. A user interface may be provided for establishing different settings or monitoring operation. Air nozzles may be used to flatten, remove folds, and/or position the article throughout the process.

Sensors for determining proper position, layout, or errors in processing, such as infrared, light, contact, or optical sensors, are used at any position or stage of processing. The sensors provide input for controlling the conveyors, clamps, drives or other components. Any now known or later developed sensors may be used.

Different clamping mechanisms, drives, sensors, conveyors, linkages, or other devices are described below. Any currently known or later developed types of these devices may be used. The options for one device are not repeated in all cases, but the other devices of the same form (e.g., clamps) may be any of the options mentioned for the one device.

FIGS. 1-5 show the separator and stacker mechanics as well as the method of separating textile articles. Towels (e.g., wash cloths) are shown in the FIGS. 2-5 at different stages of the process of separation and stacking, but other textile articles may be used.

The towels begin in a pile in a bin 12. The bin 12 is a holder, trough, top of a conveyor, bag, laundry cart, laundry truck, sling, bag, or other device for holding a collection of textile articles. As shown in FIG. 1, the bin 12 is a fixed part of the apparatus. A chute may be provided for loading the pile into the bin 12. The bin 12 is formed by side walls and a bottom, creating a volume to hold a pile of articles. The bin 12 is of any shape, such as including angled walls to dispose the textile articles towards one or more pick-up or clamping locations. Moving ribbons, pins, gravity with angled side-walls, or other structure may be used to force the articles towards a pick-up location.

In one embodiment, the bin 12 includes a hinged side-wall and drive 14. The side-wall is one or more pieces forming a barrier in the bin 12. The hinged side-wall includes one or two flat pieces hinged together. The top of the upper piece connects with the frame and the bottom of the bottom piece slides along rails and/or the bottom of the bin 12. In the embodiment shown in FIG. 2, the hinged side-wall is angled by having two flat pieces hinged together. In other embodiments, the hinged side-wall is formed of flexible material with a natural or forced curve. The curvature provides the angling.

The drive is a pneumatic, hydraulic, or electric drive, such as an air cylinder. The drive connects with part of the hinged-side wall such as connecting with one of the pieces or connecting in a generally center region. The drive causes the hinged side-wall to bend or straighten by extending or reducing a length of an air cylinder shaft, screw drive, or telescoping armature. The adjustment of the drive causes more or less angling of the hinged-side wall.

The drive and hinged-side wall 14 controls, at least in part, the bundling or pile of articles. In a position with greater angling (e.g., 45-75 degrees), the articles are maintained in the bin 12 without or with less moving to the pick-up location. When fewer items are being clamped by the clamp 16 or when a sufficiently high pile of articles is at the hinged side-wall, the hinged side-wall is straightened or adjusted to have less angling (e.g., 75-90 degrees), causing at least some of the articles to slide or fall towards the pick-up location. The control is to avoid bunching at the pick-up location of too many or too heavy a load and/or to avoid collecting articles spaced away from the pick-up location.

The articles are picked up by a clamp 16 at a pick-up location. The clamp 16 is any type of clamp. The clamp 16 is a chuck, scissor clamp, two opposing plates, jaws, pinching roller, pinching conveyors, vacuum device, combinations thereof, or other structures operable to hold one or more sheets. In one embodiment, the clamp 16 is two plates with a pneumatic cylinder to bring the plates together. One of the plates is moved towards another of the plates. The plates are sized to clamp one article (e.g., circular plates about two inches in diameter), but may end up clamping two or more articles. In other embodiments, the clamp 16 is formed from three plates with a center plate scissoring between two opposing plates. Other clamp arrangements include a piston or plunger that extends to and away from an opposing plate. The clamp 16 is sized grip one article 11 at a time, such as each jaw being about 4-8 inches in length with about ½ the length being textured flat or ridged surface for contact with the articles. Plastic, metal, wood or other materials may be used.

The clamp 16 is actuated by a pneumatic cylinder, so one or both jaws of the clamp 16 connect with the pneumatic cylinder. In alternative embodiments, an electric servo, an air driven cylinder, a hydraulic cylinder, a motor, a valve or other mechanisms are provided for actuating the clamp 16.

After clamping, the clamp 16 lifts the gripped article 11 of laundry. The grip is maintained while pulling article 11 from the pile. None, some, or all the articles may remain tangled and be pulled from the clamp 16. The clamp 16 hoists the article 11 of laundry from the pile in the bin 12.

The clamp 16 is moveable between a clamping or pick-up position and a release position. One or more sensors may be provided for controlling operation of the clamp 16. For example, sensors are positioned in the bin 12 to detect articles at the pick-up location of the clamp 16. If no textile articles are present at the pick-up location, the clamps 16 are not operated or moved.

Any drive mechanism may be used for moving the clamp 16. In one embodiment, the clamp 16 is moved along a guide by connection with a clamp block. A drive (e.g., an electric motor) drives a pulley, such as a toothed pulley with an endless timing chain or belt. Alternatively, a wench, telescoping device or other mechanism for moving clamp 16 is provided. The clamp block connects the clamp 16 to the pulley or other drive structure.

In one embodiment, a clamp support connects with the belt. The clamp support also runs along the guide. The clamp block rests against or on top of the clamp support. The drive moves the clamp support along the guide via timing chain. A sensor or timing senses when the clamp support is at the positions and then reverses the drive after any needed delay for operation of the clamp 16. The clamp support may move the full extent each cycle. The clamp block is not connected with the clamp support, but may be connected, such as with a flexible or elastic material. When the clamp 16 reaches the pile of articles, the clamp 16 may cease movement while the clamp support continues movement. The clamp support continues to a predetermined position and the clamp block separates from the clamp support at a location determined by the current pile of articles. When the clamp 16 is blocked, the clamp block ceases movement but the clamp support continues movement. Until blockage, gravity keeps the clamp block against the clamp support. As the clamp support moves downward, the clamp block also moves downwards. When the clamp support is lifted upwards, the clamp block is also lifted upwards once contact is made.

In the clamp or pick-up position, the clamp 16 is closed to grip an article 11 of laundry. The clamp 16 removes individual articles from the bin 12. The article 11 is pulled from the pile by the clamp 16 upward to the release position. The release position is determined by a sensor sensing a trailing portion (e.g., a trailing corner of the towel 11 as hanging form the clamp 16). The sensor is an optical, infrared, light, or other sensor. Mechanical sensors, such as a contact switch, may alternatively be used. Alternatively, the release position is the upward most position of the clamp 16.

The clamp 16 moves along the guide to place the article 11 between two opposing plates 18, 20. The plates 18, 20 connect to the frame with hinges so that the plates 18, 20 may rotate to more open and more closed positions with the pneumatic cylinders 22, 24 or other drive. In alternative embodiments, only one plate 18 is provided or no moveable plates are used. Other fixed side walls or no other side walls may be used with the plates 18, 20 around the release position.

The plates 18, 20 constrict the space through which the article 11 passes once the clamp 16 has cleared a bottom of the plates 18, 20. This constriction may knock articles not clamped by the clamp 16 but adhering to the article 11 off back into the bin 12. The plates 18, 20 open to allow the clamp 16 clamping any portion of the article 11 to pass. The plates 18, 20 narrow the space through which the article 11 passes to remove clinging article 11.

Figure 3:
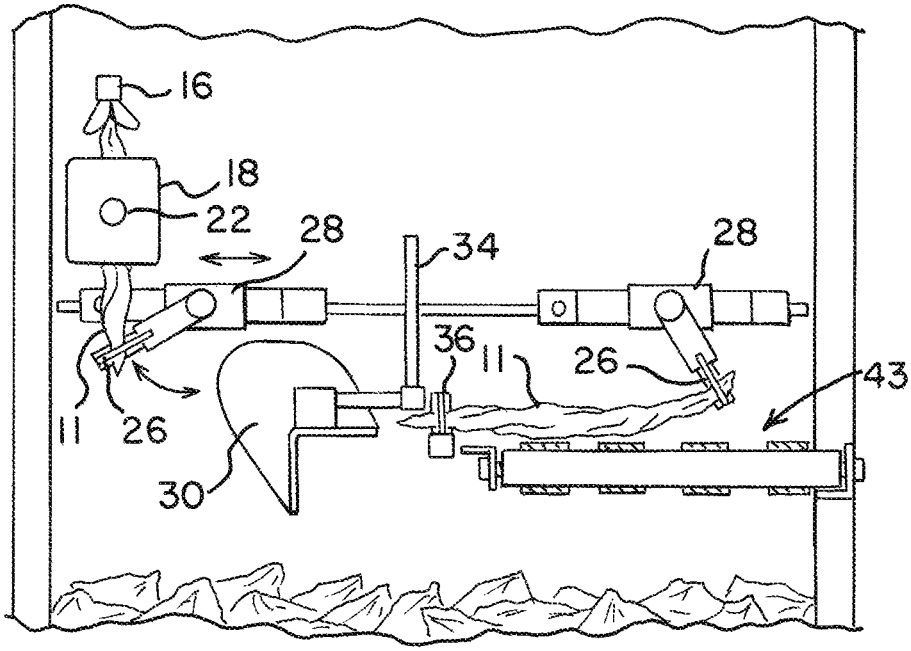
FIG. 3 is a side view of one embodiment of an arrangement for positioning a separated textile article over a conveyor.

When the clamp 16 reaches the release position, the lowest hanging portion of the article 11 remains lower than the bottom of the plates 18, 20. This lowest part of the article is likely a corner. Referring to FIG. 3, once the lowest part is sensed at the release position, a clamp 26 is moved horizontally along a guide. Any type of clamp may be used, such as a scissors clamp.

The clamp 26 clamps the article 11 adjacent to or near the corner. "Near" is used to account for variation or tolerance, such as within 3 inches of the corner. Once the clamp 26 clamps the article 11, the clamp 26 begins to rotate downward. After the rotation begins, the clamp 16 is opened. The clamp 16 releases the article 11 after reaching the release position and after the clamp 26 clamps the article 11 and begins rotating. The rotation while still held by clamp 16 causes a snapping action on the towel. Other relative timing may be used.

Figure 4:
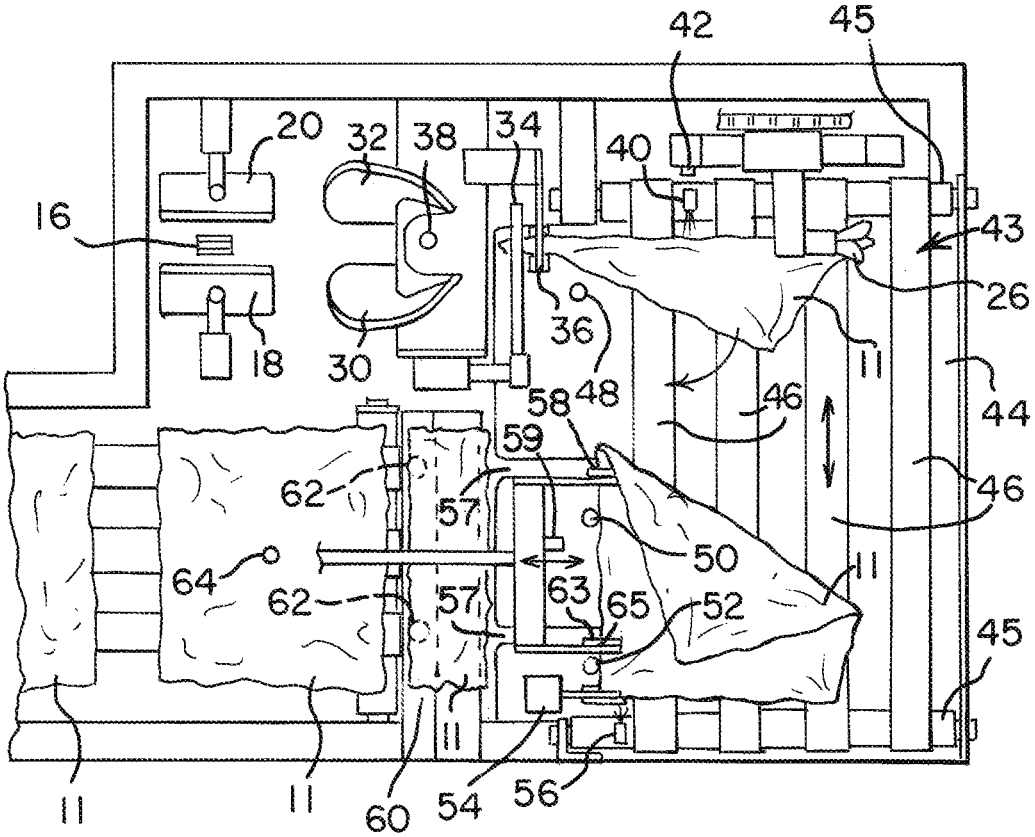
FIG. 4 is a top view of one embodiment of an arrangement for locating an edge of the textile article and stacking the article.
Figure 5:
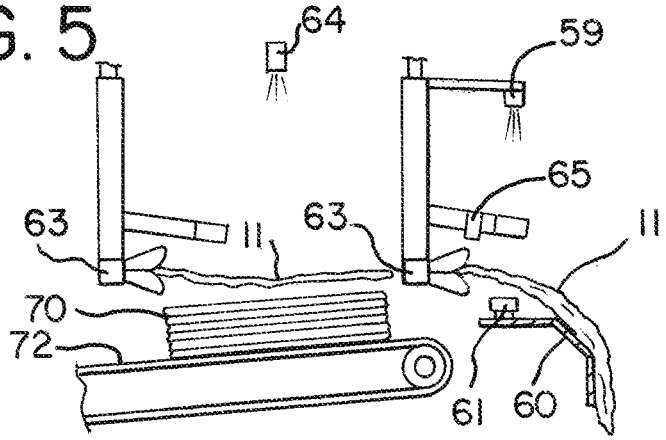
FIG. 5 is a side view of one embodiment of an arrangement for stacking the article.

As shown in FIGS. 3 and 4, the clamp 26 is moveable along a guide in a horizontal position, dragging the article 11 by the corner, now a leading corner. To extend the article 11 away from the clamp 26, the clamp 26 connects along an arm to a rotating support 28. The rotating support is driven pneumatically, electrically, or hydraulically to rotate the clamp 26 and the clamped article 11 downward. Centrifugal force and gravity extend the article 11 downward. Any range of motion may be used, such as about 90, 170, or 180 degrees of rotation. About accounts for 30% variation.

As the support 28 is moved horizontally, the article 11 hanging from the clamp 26 is dragged from the plates 18, 20 in the constricted position, extended by centrifugal force and gravity, and then between two plates 30, 32. The plates 30, 32 for a U or V shape through which the trailing part of the article 11 passes. Other shapes may be used. The clamp 26 may likewise pass between the plates 30, 32 or may pass above the plates 30, 32.

As the article 11 moves out of between the plates 30, 32, the article 11 passes through the open jaws of the clamp 36. The clamp 36 is of any type. In one embodiment, the clamp 36 includes two parallel plates for one jaw with an opposing single plate for the other jaw. The single plate passes into or partly between the parallel plates. Other arrangements may be used.

As the article 11 passes through the open jaws of the clamp 36, a bar, rod, or plate 34 rotates downward to press down on the article 11 between the plates 30, 32 and/or the clamp 36. The weight of the bar 34 presses on the article 11, but a driven downward force may be used. The bar 34 acts to hold the article 11 in the jaws of the clamp 36 for clamping. In alternative embodiments, the bar 34 is not provided, is positioned after the clamp 36, or is a brush or other object in a fixed position.

An optical or other sensor 38 detects the trailing corner of the article 11 near the clamp 36. The clamp 26 drags the article 11 of laundry across the clamp 36 until the trailing corner or end is sensed near or at the clamp 36. The clamp 36 clamps the trailing corner or near the trailing corner of the article 36. The article 11, as clamped by the clamps 26, 36, extends between sides of a conveyor 43. The article 11 extends completely or partially across the width of the conveyor 43 at one end of the conveyor 43, but may be at a center portion. Part of the article 11 rests on the conveyor 43. The article 11 is positioned over the conveyor 43 perpendicular to a direction of conveyance of the conveyor 45. The direction of conveyance is shown by the double arrow on the conveyor 43 in FIG. 4.

The conveyor 43 has two or more rollers 45 and one or more endless belts 46. For example, three or four endless belts 46 with any spacing between the belts (e.g., 1-2 inches) is provided. The belts are of any width, such as 1-6 inches. A drive drives one or both rollers to move the cloth, fabric, rubber, or plastic belts 46. In one embodiment, a single endless belt is provided. The conveyor 43 includes a platform 44 on which the belts 46 rest or pass over. The platform 44 is metal, but other materials may be used.

After clamping by the clamp 36, the bar 34 is raised. One or more air nozzles 40, 42 blow on the article 11 while clamped between the clamps 26, 36 and on the conveyor 43. The air nozzles, such as flat slit nozzles, blow compressed air. The air nozzle 40 is may be on the wall of the frame pointing downward while centered laterally on the article 11. The air nozzle 40 is directed under the article 11 and above the conveyor 43 to cause the article 11 to un-bunch or lay out flatter on the conveyor 43. Air is blown down the side of the article 11 nearest to the wall or end of the conveyor 43 so the air hits the conveyor 43 and forces any dropping edges to turn and go with the conveyance of the conveyor 43. The air nozzle 42 connects with the clamp 26 and is directed to blow down on the article 11 to un-bunch or lay out flatter on the conveyor 43. The air nozzles 40, 42 are directed at the article to remove folds. Rather than being bunched as resting on the conveyor 43, the article 11 has fewer folds to rest more flatly. Additional, different, or fewer air nozzles may be used, such as just the air nozzle 40. The air nozzles may be at different positions. The belts 46 may be operated to draw the resting part of the article 11 away from the clamps 26, 36, also assisting in laying out the article 11 flat on the conveyor. Once blown, the article 11 likely forms a triangular shape on the conveyor 43.

Depending on which side of the conveyor 43 is to be used for clamping an edge of the article 11, one of the clamps 26 or 36 releases the article 11 after the blowing. FIG. 4 shows the clamps 58 grabbing the edge from the left side of the conveyor 43, so the clamp 26 releases while the clamp 36 maintains the hold on the article 11. In another embodiment, the clamp 36 releases, allowing rotation of the edge of the article 11 with the other side of the conveyor 43. In yet other embodiments, the rotation is to align the straight edge of the article 11 perpendicular to the direction of conveyance.

One of the two clamped corners or corner portions of the article 11 is released and the other held to rotate the article 11 on the conveyor 43. During or after the release, the conveyor 43 conveys the article 11 from one end towards another end. Since the clamp 36 is holding the article 11, the article 11 rotates due to the conveyance. The edge of the article 11 on the conveyor rotates about 45 degrees to cover the sensor 48 on the platform 44. About accounts for various shapes and layouts of the article 11, where the sensor 48 determines the amount of rotation based on the original positioning of the article 11 on the conveyor 43 after blowing by the air nozzles 40, 42. The optical, electric, or other sensor 48 detects the edge of the article 11 due to the rotation.

When the rotation places the edge substantially parallel with the side of the conveyor 43 or direction of conveyance, the sensor 48 triggers release of the clamp 36. Substantially is within +/−10 or within +/−20 degrees. Where the article 11 is not lying flat, the sensor 48 may be triggered without a straight edge being substantially parallel. The sensor 48 is along a side of the conveyor 43 within a width or distance of the article 11 from the clamp 36. The sensor 48 may be aligned with the clamp 36 along a line parallel to the direction of conveyance or may be offset (e.g., offset by 3 or fewer inches). The clamp 36 releases the article 11 after the rotation in response to the triggering of the sensor 48.

Once released, the article 11 is conveyed from one end of the conveyor 43 towards the other end. As the article 11 is carried by the belts 46, the article passes over one or more sensors 50, 52 in the platform 44. The sensors 50, 52 may be in other positions, such as above the conveyor 43 directed towards the conveyor 43. One or both sensors 50, 52 are used to determine when the article 11 is at the end or near the end of the conveyor 43 and/or at a position for clamping by the clamp 54.

A clamp 54 is positioned at an end of the platform 44 opposite the end on which the clamp 36 is positioned, but other positions may be used. The clamp 54 is aligned with the sensor 48 and/or the clamp 36 along the conveyance direction, but may be offset. Any type of clamp may be used, such as a scissor clamp. The clamp 54 is positioned between a roller of the conveyor 43 and the platform to grip the article 11 resting on the belts 46 and platform 44. Other positions may be used, such as in a slot in the platform 44 spaced from the end of the conveyor 43. The clamp 54 is positioned to clamp at or near a leading part of the edge. The clamp 54 is positioned so the corner or near the corner of the article 11 is clamped while the article 11 rests on the conveyor 43.

Once clamped by the clamp 54, the conveyor 43 reverses direction. The ribbons 46 of the conveyor 43 change from conveying, on the top surface, towards the clamp 54 to away from the clamp 54. Due to the clamping at or near the corner of the article 11, this conveyance away from the clamp 54 rotates the article 11.

One or more air nozzles 56 positioned by or on the clamp 54 blow air across top and/or bottom surfaces of the article 11. Other positions, such as above or through the platform 44 may be used. Since the corner of the article 11 is clamped, the air tends to unfold the article 11 while keeping the article 11 in place on the conveyor 43. The article 11 transitions from having a single fold (triangular shape) or multiple folds to flat. Alternatively, a position of a fold is moved from near a diagonal to further away from the corner being clamped by the clamp 54. In some cases, the air blasts may fail to remove folds.

The blowing may reorient the article 11 on the conveyor 43. The clamping while conveying rotates the article 11 so that an edge is substantially parallel with a side of the conveyor 43 and/or the direction of conveyance.

Once the rotation causes the article 11 to cover the sensor 50 and/or the sensor 52, the clamp 54 is released. When the edge of the article is positioned substantially parallel to the direction of conveyance, the clamp 54 releases the article 11. The conveyor 43 conveys the article away from the clamp 54, back towards the clamp 36.

The sensor 52 senses when the article 11 no longer covers the sensor 52. The conveyor 43 is stopped with the article 11 in this position. The edge of the article 11 lays flat and substantially in parallel to a side of the conveyor 43. Two slots 57 in the platform 44 extend under the edge of the article 11. The platform 44 supports the edge over the slots 57 after any rotation. The article 11 either lays flat or lays with one or more folds. An edge or edges cover the slots 57.

The edge is grabbed by moveable clamps 58. Any number of slots 57 and corresponding clamps 58 may be used, such as the two shown in FIG. 4. The moveable clamps 58 are of any type, such as scissor clamps. In alternative embodiments, the moveable clamps 58 have a flat or spatula shape for shoveling the edge of the article 11 off the conveyor 43 without the slots 57. A clamp support runs along a guide, moving the pair of clamps 58 horizontally. Any type of drive may be used. The clamp support may include joints or hinges with actuators for spreading the clamps 58 apart from each other. The clamps 58 are at one distance apart to align with and pass into the slots 57. Once outside the slots, the clamps 58 may be spread to tension the edge held between the clamps 58.

The clamps 58, 63 are positioned to move through the slots 57 to the edge of the article 11. Sensors on the clamps 58 detect the edge within the clamps 58, 63. Each clamp 58, 63 separately detects the article 11 relative to the clamp 58 to deal with the edge not being perfectly parallel to the side of the conveyor 43. Once the edge is detected in a given one of the clamps 58, 63, that clamp 58, 63 closes on the article 11. After the clamp 54 releases the article 11 and the conveyor 43 positions the article 11 relative to the slots 57, both the clamps 58, 63 clamp the article 11.

The clamps 58, 63 drag the article 11 off the platform 44 of the conveyor 43. The clamps 58, 63 drag the article 11 over a gap between the platform 44 and a sensor platform 60, and to the stack 70 on an indexing conveyor 72.

The gap allows the article 11 to hang down from the clamps 58, 63. Any size gap may be used. Gravity assists in flattening out the article 11, removing any folds. When the article 11 is grabbed at a single edge, then the gap may result in the article 11 hanging flat or without folds.

One or more air nozzles 59, 61, and 65 may assist in flattening the article 11 in the gap. The air nozzle 65 is by or on the clamp 63, such as being supported by the clamp support and being adjacent to the clamp 63. The air nozzle 65 is directed downward along the article 11 as hanging in the gap. The air nozzle 59 is on the support for the clamps 58, 63, such as directed at the article 11 from a different angle than the air nozzle 65. The clamps 58, 63 pause with the article 11 in the gap to allow the air nozzles 59, 61, and 65 to blow on the article. Alternatively, the clamps 58, 63 continuously move with the air nozzles 59, 61, and 65 blowing as the clamps 58, 63 move the article 11 through the gap.

The air nozzle 61 is positioned on the sensor platform 60 and directs air perpendicular to the article 11 as the article 11 is suspended from the clamps 58 in the gap. The air nozzle 61 may be angled from perpendicular (e.g., 10-30 degrees). Other arrangements of air nozzles 59, 61, 65 may be used. Fewer or additional air nozzles may be used.

The sensor platform 60 is a plate, saddle, or other shape formed from metal or other material. The sensor platform 60 includes the electric or other type of sensors 62. Two or more sensors 62 are directed to sense the article 11 passing over holes in the sensor platform 60. As the clamps 58 move the article 11 past the gap, the article 11 passes over the sensor platform 60. Due to the clamps 58, 63 being spaced away from the sensor platform 60 at a closest point of no more than ½ the length of the article 11, some of the article 11 slides over the sensor platform 60. Other distances may be used, such as 2-4 inches.

Based on the sensors 62, the sensor platform 60 is configured to sense that the article 11 of laundry is flat as dragged over the sensor platform 60. The sensors 62 are aligned so that a trailing edge of the article 11 is detected. If the trailing edge is detected at a same or similar (e.g., within 0.5 seconds) time by both sensors 62, then the article 11 is detected to be laid out flat in a single layer. Where the clamps 58, 63 hold the article with the article folded, then the sensors 62 detect the trailing edge not being even (i.e., both sensors 62 are not triggered at a same time). Alternatively or additionally, the sensors 62 detect a length of the article 11 from the clamps 58, 63 to the back or trailing edge. Using the known distance of the clamps above the sensor platform and/or when the article 11 is sensed being dragged over the sensors 62, the time based on the speed of the clamps 58, 63 for the trailing edge to be detected by each sensor is detected. If the time indicates the article 11 as shorter than a threshold for either of the sensors 62, then the article 11 is folded or not laid out in single layer. Other approaches may be used to sense whether the article is flat or not.

When the article 11 is not flat, the movement of the clamps 58, 63 is reversed. The article 11 is returned to be over or in the gap. The clamps 58, 63 release the article 11 in the gap. The gap is over the bin 12, so the article 11 is returned to the bin 12 to be processed again. When the article 11 is flat, then the moveable clamps 58, 63 drag the article 11 over the sensor platform 60 and onto the stack 70. The article 11 is held over the stack. Based on sensing or position of the clamps 58, 63, the article 11 is positioned in a same lateral position as previous articles 11 to stack the article 11. The clamps 58, 63 holding a leading edge place the article 11 on the stack 70.

Once the article 11 is positioned on the stack 70, the clamps 58, 63 release the article 11. The conveyor 72 is an indexing conveyor, such as having an actuator to position a top of the stack 70 at given distance from a height of the clamps 58. This allows the clamps 58 to release the article 11 with a consistent position of the article 11 relative to the stack 70. The portion of the article 11 still suspended above the stack 70 falls to the stack 70.

To prevent corners of the article 11 from folding inward due to the release by the clamps 58, 63 and/or dragging of the article 11 over the stack 70, an air nozzle 64 is directed downward towards a center of the article. Air is blown downwards towards the center of the article 11 during or after the release by the clamps 58 (e.g., as the article 11 is placed on or while positioned on the stack 70). By releasing the edge of the article 11 as the blowing of air occurs, the article 11 is forced by gravity and air from the clamps 58. Any corners folded inward are blown outwards again to ready the stack 70 for stacking of the next article 11. The blowing is timed to the release so that the article 11 lays flat on the stack 70.

The index conveyor 72 conveys the stack for further processing or packing. As an alternative to the index conveyor 72, a platform or other non-conveying surface may be used for stacking.

In a further embodiment, two or more processing chains are provided. The same bin 12 is used, but different clamps 16 feed to different levels. Each level is a duplicate of the processing (e.g., from clamp 16 to stack 70) discussed above. The levels are positioned one above the other. The different levels create separate stacks 70 or add to a same stack, such as by raising or lowering the stacks or the clamps 58, 63 dropping articles 11 onto the stack 70 or feeding to a separate stacking machine.

In other embodiments, the processing chain is used to separate and feed to an ironer or folder. For example, napkins are separated from the pile, then feed to an ironer or folder in a separate frame.

While the invention has been described above by reference to various embodiments, it should be understood that many changes and modifications can be made without departing from the scope of the invention. For example, any number of additional stages may be provided. Different clamp, conveyor, sensor, actuator or drive structures may be used, including now known or later developed structures. It is therefore intended that the foregoing detailed description be understood as an illustration of the preferred embodiment of the invention and not as a definition of the invention. It is only the following claims, including all equivalents, that are intended to define the scope of the invention.

What is claimed is:

1. An apparatus for processing textile articles, the apparatus comprising:

a first conveyor having first and second rollers at first and second ends connected by first and second sides, one or more endless belts extending between the first and second rollers, the conveyor configured to convey from the first end to the second end; and a first clamp positioned to clamp at least a first one of the textile articles while the textile article extends between the first and second sides, the first clamp configured to clamp the first one of the textile articles at a location spaced from any endless belts, including the one or more endless belts, for conveying the first one of the textile articles while clamped by the first clamp;

wherein the first conveyor is configured to convey the first textile article towards the second end while the first clamp clamps the first textile article, the first textile article rotating about an axis orthogonal to a top surface of the conveyor, the axis being at the first clamp on the conveyor due to the conveyance while the first article is clamped, the first clamp configured to release the first textile article when the rotation places an edge of the first textile article substantially parallel with the first side.

2. The apparatus of claim 1 wherein the conveyor comprises at least three of the endless belts resting on a plate.

3. The apparatus of claim 2 wherein the plate includes an electric sensor adjacent to the first side, the electric sensor configured to detect when the rotation places the edge of the first textile article substantially parallel with the first side.

4. The apparatus of claim 1 wherein the first clamp is configured to clamp the first textile article adjacent to a trailing corner of the first textile article.

5. The apparatus of claim 4 further comprising a second clamp configured to clamp adjacent to a leading corner of the first textile article, drag the first textile article across the first clamp until the first clamp clamps the trailing corner, and release the leading corner for the rotation.

6. The apparatus of claim 5 further comprising a bar configured to press the textile article into the first clamp.

7. The apparatus of claim 5 further comprising an air nozzle directed at the first textile article while clamped by the first and second clamps such that the first textile article partly rests on the conveyor with fewer folds.

8. The apparatus of claim 1 wherein the first clamp is adjacent to the first end;

further comprising a second clamp adjacent to the second end, the second clamp configured to clamp adjacent a corner of the first textile article while the first textile article rests on the conveyor;

wherein the conveyor is configured to reverse direction of conveyance and convey from the second end to the first end while the second clamp clamps the first textile article, the first textile article rotating on the conveyor from the conveyance while the first article is clamped by the second clamp, the second clamp configured to release the first textile article when the rotation places the edge of the first textile article substantially parallel with the first side.

9. The apparatus of claim 1 further comprising a second clamp configured to clamp the edge and drag the first textile article off the conveyor, over a gap, over a sensor platform, and onto a stack of the articles, the first textile article hanging into the gap, and the sensor platform configured to sense that the first textile article is flat as dragged over the sensor platform.

10. The apparatus of claim 9 further comprising an air nozzle configured to direct a blast of air towards a center of the first textile article above the stack.

11. A method for processing textile articles, the method comprising:

positioning a first textile article over a conveyor perpendicular to a direction of conveyance of the conveyor;

holding a portion of the first textile article while the conveyor conveys the first textile article;

rotating the first textile article on the conveyor due to the holding while the conveyor conveys, the rotating being about an axis orthogonal to a top surface of the conveyor on which the first textile article rests, the axis being at the portion being held, and the rotating being due to the conveyance while the first textile article is being held, the rotating being about 45 degrees such that an edge of the first textile article is substantially parallel with the direction of conveyance; and releasing the first textile article from the holding after the rotating while the conveyor conveys.

12. The method of claim 11 wherein positioning comprises dragging the first textile article over a first clamp with a second clamp, and wherein holding comprises holding a trailing corner of the first textile article with the first clamp and releasing the second clamp.

13. The method of claim 12 further comprising blowing the first textile article while clamped by the first and second clamps.

14. The method of claim 11 further comprising conveying the first textile article after the releasing to a clamp, clamping the first textile article with the clamp, and then reversing the direction of conveyance, the reversing while clamping with the clamp rotating the first textile article.

15. The method of claim 14 further comprising blowing the first textile article from adjacent to the clamp while clamped by the clamp.

16. The method of claim 11 further comprising grabbing an edge of the first textile article after the releasing, moving the first textile article over a gap such that gravity pulls a part of the first textile article into the gap, blowing air on the first textile article while the part is in the gap, and placing the first textile article on a stack.

17. The method of claim 16 further comprising blowing air downwards towards a center of the first textile article as the first textile article is placed on the stack.

18. An apparatus for processing textile articles, the apparatus comprising:

a clamp positioned to clamp the first textile article; and a conveyor having a first end and a second end, the conveyor configured to convey a first textile article in a first direction from the first end to the second end to the clamp positioned by the second end, the conveyor configured to reverse direction from the first direction to a second direction from the second end to the first end while the clamp clamps the first textile article by the second end, the conveyance in the second direction while the clamp clamps rotating an edge of the first article to be more parallel with the first and second directions, the rotating of the first textile article being on a top surface of the conveyor about an axis orthogonal to the top surface due to the conveyance while the clamp clamps.

19. The apparatus of claim 18 further comprising an air nozzle adjacent the clamp and directed at the first article on the conveyor while clamped by the clamp.

20. The apparatus of claim 18 wherein the conveyor comprises a platform with slots, the edge being over the slots after the rotation;

further comprising further clamps positioned within the slots to clamp the edge.

21. An apparatus for processing textile articles, the apparatus comprising:

a first platform operable to support an edge of a textile article;

a movable clamp operable to clamp the edge and drag the textile article off the platform and over a gap;

an air nozzle configured to blow air onto the textile article when over the gap; and a second platform having sensors where the moveable clamp is operable to drag the textile article over the second platform, the gap being between the first and second platforms.

22. The apparatus of claim 21 wherein the moveable clamp is configured to return the textile article to the gap and release the textile article in the gap in response to the sensors sensing that the textile article is not flat.

23. The apparatus of claim 21 wherein the moveable clamp is configured to place the textile article on a stack in response to the sensors sensing that the textile article is flat.

24. A method for stacking a textile article, the method comprising:

holding the textile article over a stack;

blowing downward towards a center of the textile article while the textile article is positioned over the stack, the blowing moving a folded corner of the textile article outwards relative to the center; and releasing the textile article timed with the blowing.

25. The method of claim 24 wherein holding comprises holding an edge with clamps, and wherein releasing comprises releasing the edge as the blowing occurs.

* * * * *